US005784716A

United States Patent [19]

Holt et al.

[11] Patent Number: 5,784,716

[45] Date of Patent: Jul. 28, 1998

[54] ARTICULAR CONDITIONING SYSTEM AND METHOD

[76] Inventors: Steven James Holt; Alan Wayne Holt, both of 2383 Wine Ridge Dr., Birmingham, Ala. 35244

[21] Appl. No.: 714,595

[22] Filed: Sep. 16, 1996

Related U.S. Application Data

[62] Division of Ser. No. 300,409, Sep. 2, 1994, Pat. No. 5,555,562.

[51] Int. Cl.[6] ..... A63B 21/065

[52] U.S. Cl. ..... 2/69; 2/79; 482/105

[58] Field of Search ..... 482/105, 102; 2/102

[56] References Cited

U.S. PATENT DOCUMENTS

| | | | |
|---|---|---|---|
| 3,278,184 | 10/1966 | Rosenbaum | 482/105 |
| 3,838,853 | 10/1974 | Fredenhagen | 482/105 |
| 4,382,302 | 5/1983 | Watson | 2/102 |
| 4,384,369 | 5/1983 | Prince | 482/105 |
| 4,602,387 | 7/1986 | Zakrewski | 2/102 |
| 4,658,442 | 4/1987 | Tomlinson et al. | 2/102 |
| 4,910,802 | 3/1990 | Malloy | 2/69 |
| 5,004,227 | 4/1991 | Hoffman | 482/105 |
| 5,048,125 | 9/1991 | Libertini et al. | 2/79 |
| 5,144,694 | 9/1992 | Conrad Daoud et al. | 482/105 |
| 5,308,305 | 5/1994 | Romney | 482/121 |
| 5,367,708 | 11/1994 | Fujimoto | 2/69 |

*Primary Examiner*—Amy B. Vanatta

*Attorney, Agent, or Firm*—Dickstein Shapiro Morin & Oshinsky LLP

[57] ABSTRACT

A flexible articular conditioning system includes a plurality of elongated, solid, non-shifting weight members. The weight members may be removable for cleaning, and may be replaced by progressively heavier weight sets. Weight is not merely added to the wearer. The weights are advantageously evenly distributed across the body and located above and below the respective joint cavities. The disclosed systems are particularly well suited for sports specific training. The articulates may be properly and safely conditioned while exercising the muscles that control those articulates.

13 Claims, 5 Drawing Sheets

ARTICULAR CONDITIONING SYSTEM AND METHOD

This application is a division of application Ser. No. 08/300,409, filed Sep. 2, 1994 now U.S. Patent No. 5,555,562, issued Sep. 17, 1996.

BACKGROUND OF THE INVENTION

1. Field of the Invention

The term "articulates" is used herein to mean the joints and jointed segments of the human body.

2. Description of the Related Art

It is known to apply weights to an athlete in training to improve the athlete's muscle strength and cardiovascular condition. Examples of such known systems include ankle weights and wrist weights.

The known ankle and wrist weights are unsatisfactory because they place excessive stress on the articulates and over time may cause minor ligament tears, causing the articulates to become less flexible and elastic.

Another problem with the known weight systems is that they shift position during use. The conventional weights cannot be maintained in position with respect to the wrists and ankles. This problem is aggravated by the fact that conventional weights are filled with shiftable particulate material and/or liquid. Shifting of the known systems during use creates jarring forces that over time damage tendons and cause other damage to the articulates.

Moreover, conventional weights are not supported except by the articulates being exercised. All of the inertial forces created by such weights must be resisted by the joints themselves. For example, when a wrist weight is worn during a throwing motion, a large inertial force is applied to the shoulder and elbow at the conclusion of the throwing motion, when the movement of the forearm is stopped. The inertial force of the wrist weight applies an excessive force on the elbow in an uncontrolled manner. This inertial pulling effect places undue stress on the tendons and ligaments of the elbow and shoulder, causing the joints to lose their elasticity over time. In general, a weight system that is concentrated below the insertion point of the respective joint, for example below the elbow, will cause excessive stretching of the joint cavity over time.

Training with shiftable and poorly distributed weights can also cause unbalanced muscle strength. For example, if wrist weights are used for a sports specific function involving rapid arm movements, overdevelopment in the longer (anterior) muscles of the shoulder may occur rather than in the smaller rotator cuff and scapular (posterior) muscles. Over time, this strength imbalance causes tightness in the front of the shoulder with increasing discomfort in the anterior superior glenohumeral area.

Weight systems are described in the following U.S. patents, the entire disclosures of which are incorporated herein by reference: U.S. Pat. Nos. 4,384,369 (Prince); 4,910,802 (Malloy); 4,953,856 (Fox); 5,010,596 (Brown); 5,048,125 (Libertini); 5,109,546 (Dicker); and 5,144,694 (Daoud).

All of the known systems are unsatisfactory. They are poorly distributed, shiftable, subject to undesired inertial effects, unnecessarily complicated, inconvenient to use, and/or too expensive to manufacture.

The documents listed below, the entire disclosures of which are incorporated herein by reference, generally relate to articles of apparel and/or the art of conditioning systems:

U.S. Pat. No. 5,105,473 (Valtakari); U.S. Pat. No. 4,065,814 (Fox); Francis et al., "Weighty Issues," *Idea Today* 47 (1988); Dominguez, *The Complete Book of Sports Med.* 152 (1979); Brylinsky et al., "The Effect of Using a Weighted Softball on Pitching Velocity, Wrist Strength and Handgrip," 6 *J. Applied Sport Sci. Res.* 170 (1992); Potteiger et al., "Training the Pitcher: Physiological Perspective," 11 *NSCA J.* 24 (1989); Legwold, "Guide to a Good Arm," *Sport* 73 (1987); Pappas et al., "Baseball: Too Much On a Young Pitcher's Shoulders?" 19 Physician & Sports Med. 107 (1991); Harman, *Designing Resistance Training Programs* 50; Yesis, "Sports Specific Strength Training," *Scholastic Coach* 29 (1992); Montoye, Michigan State U., Res. Q. Vol. 33, No. 4; Praktika, "The Athlete's Skeletal Adaptation to Physical Loads" 7:38 (1984).

SUMMARY OF THE INVENTION

The present invention overcomes the disadvantages of the prior art by providing an articular conditioning system including a flexible main portion, a flexible arm portion, and a flexible weight member extending along substantially the full length of the arm portion, wherein the weight member has tensile strength for resisting movement of a distal portion of the weight member away from a proximal portion of the weight member. The conditioning system may further include pockets or other suitable means for connecting the weight member to the arm portion and for preventing the weight of the weight member from shifting with respect to the distal end of the arm portion.

The present invention also relates to an articular conditioning system, comprising: (A) a main portion; (B) a flexible portion (such as an arm, leg or back portion) connected to the main portion; (C) a flexible weight member extending along substantially the full length of the flexible portion; (D) means for connecting the weight member to the flexible portion and for preventing the weight of the weight member from shifting with respect to the flexible portion; and (E) a second flexible weight member, with the length of the second weight member being substantially the same as that of the first weight member, and wherein the second weight member is heavier than the first weight member.

The present invention also relates to a method of exercising or otherwise conditioning a human body. The method includes the steps of wearing a suit with a first set of weight members, removing the first set, and then wearing the suit with a second set of weight members heavier than the first set.

In a preferred embodiment of the invention, weights are equally distributed in a preferred pattern and are not permitted to shift with respect to the body portion to which they are attached. The weights are preferably formed of a solid, non-shiftable material. The weights are also preferably placed above and across the respective articulate cavities such that upper portions of the weight members contribute to the support of the lower portions. Thus, in a preferred embodiment of the invention, the weights will not shift either in the direction of movement or in a centripetal direction, i.e. axially with respect to the distal portion of the articulate.

An object of the invention is to provide a system with weight members formed of a non-particulate, soft, flexible, elastomeric substance. In a preferred embodiment of the invention, the weight members are formed of a non-shiftable material and the weight members themselves are held tightly against the body so as not to shift during use.

Another object of the invention is to provide an improved resistance system for use in sports specific training. It has long been recognized that the best way to train for a particular sport is to train within that sport.

Another object of the present invention is to provide an even distribution of weight across the body and along the entire lengths of the articulates such that there is no strain on the weaker joints.

Another object of the invention is to provide a system that conditions the bones, joints and supporting muscles and ligament tissues for the joints. An important feature of the present invention is that it does not merely add weight to the user, but also allows the user to properly and safely condition the articulates while exercising the muscles that control those articulates.

Another object of the invention is to provide an exercise system for increasing strength, endurance and flexibility, and for prolonging the useful life of the articulates.

Another object of the invention is to provide individualized weighting with gradual and systematic progression of increased weighting within specific limitations.

Another object of the invention is to provide a weight training system with a specific distribution of the percentage weighting to conform to the body's natural weight distribution.

Another object of the invention is to provide a conditioning system with a distribution of weight that is designed to mimic the body so as to not hinder movement but to enhance conditioning.

An advantageous feature of the present invention is that it distributes weight completely over and across the articulates, which mimics the body's own construction. The invention also prevents disproportionate weighting and avoids the corresponding stress that would be imposed on the articulates by such disproportionate weighting. By preventing disproportionate weighting, the invention reduces the possibility of injury.

The present invention may be used in a wide variety of activities, including baseball (pitching, batting and fielding), football (all positions), basketball, tennis, golf, swimming, walking, hockey, aerobics, soccer, running, volleyball, biking, and other sports and athletic events.

The weight of the elastomeric weight members is preferably evenly distributed across the shoulders and arms, back and legs, providing optimum resistance, and improving the efficiency of the exercise activity. The present invention permits the user to perform the desired sports activity or other activity at full speed. This allows the muscles directly involved in the event to be strengthened consistent with the use of those muscles in the sports activity.

Other objects and advantages of the present invention will become apparent from the following detailed description and drawings illustrating preferred embodiments of the present invention.

DETAILED DESCRIPTION OF PREFERRED EMBODIMENTS

Figure 1:
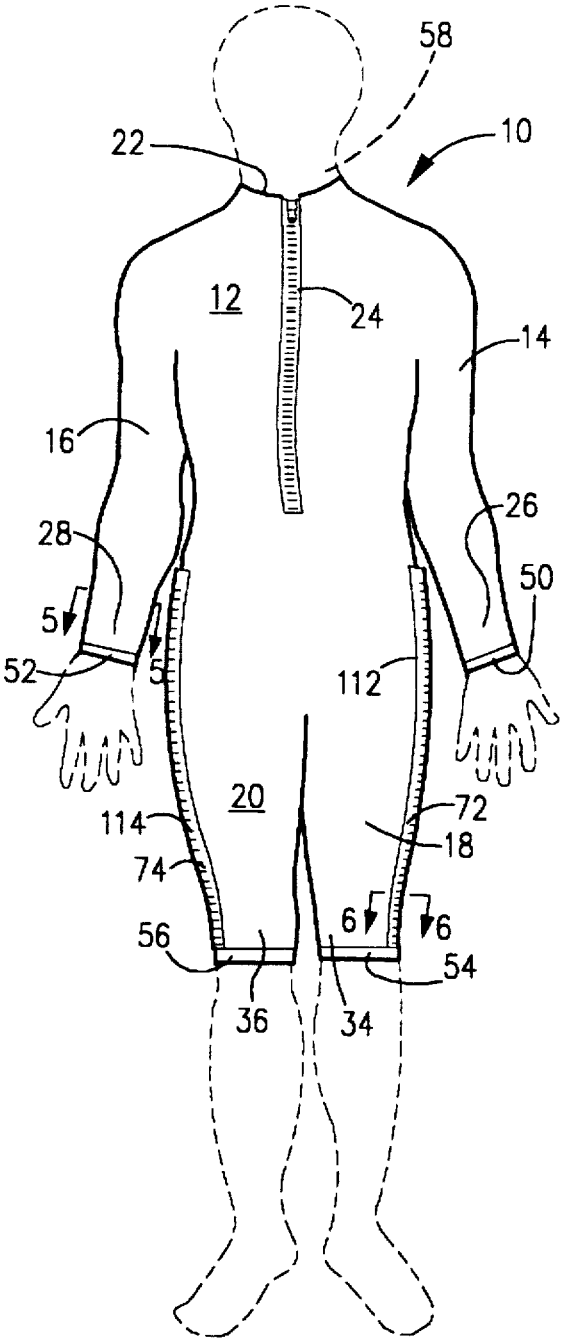
FIG. 1 is a front elevational view of a conditioning body suit system constructed in accordance with a preferred embodiment of the present invention.
Figure 2:
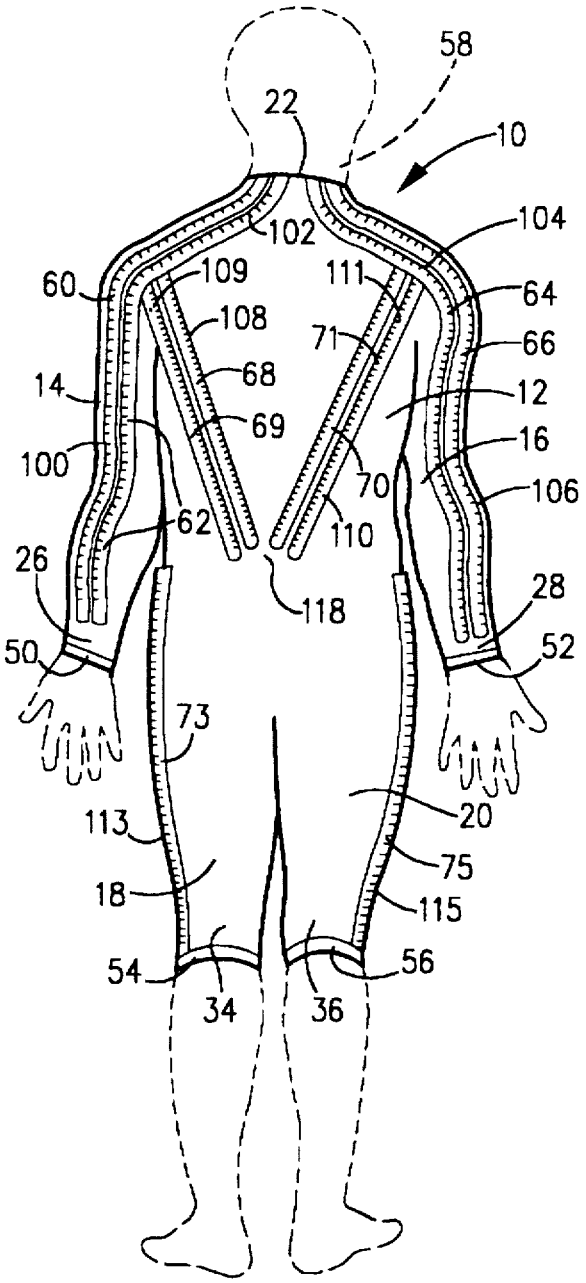
FIG. 2 is a rear elevational view of the conditioning system of FIG. 1.

A conditioning body suit 10 constructed in accordance with the present invention is shown in FIGS. 1 and 2. The body suit 10 has a torso portion 12, arm portions 14, 16, and leg portions 18, 20. The suit 10 is constructed in one piece. The arm portions 14, 16 and the leg portions 18, 20 are integrally connected to the torso portion 12. The torso portion 12 has a collar 22 and a main zipper 24.

The suit 10 is shown in use in FIG. 1, with the torso portion 12 surrounding the wearer's torso, and with the arm portions 14, 16 surrounding and extending substantially along the entire lengths of the wearer's arms. In the illustrated embodiment, the distal ends 26, 28 of the arm portions 14, 16 are located at the wearer's wrists. The lower ends 34, 36 of the leg portions 18, 20 are located just below the knees.

The distal ends 26, 28 of the arm portions 14, 16 are connected to the wrists by suitable securing means, such as by elastic straps 50, 52 with adjustable VELCRO® hook and loop type fasteners. The lower leg ends 34, 36 are held in place beneath the knees by one inch elastic bands 54, 56 or by other suitable means. The collar 22 fits snugly around the wearer's neck 58.

The suit 10 is preferably formed of a stretchable material and is sized to fit tightly around the wearer's torso, arms and legs. In the illustrated embodiment, the suit 10 is constructed of a durable, lightweight and breathable material such as LYCRA® stretch cloth, and is worn skin-tight. The tightness of the suit 10 causes dilation of the blood vessels within the arms, legs and torso, which helps maintain warmth within the muscles and tendons of the articulates being exercised. The skin-tight, stretchy, lightweight and breathable material of the illustrated embodiment is particularly well suited for safe and effective conditioning.

Figure 3:
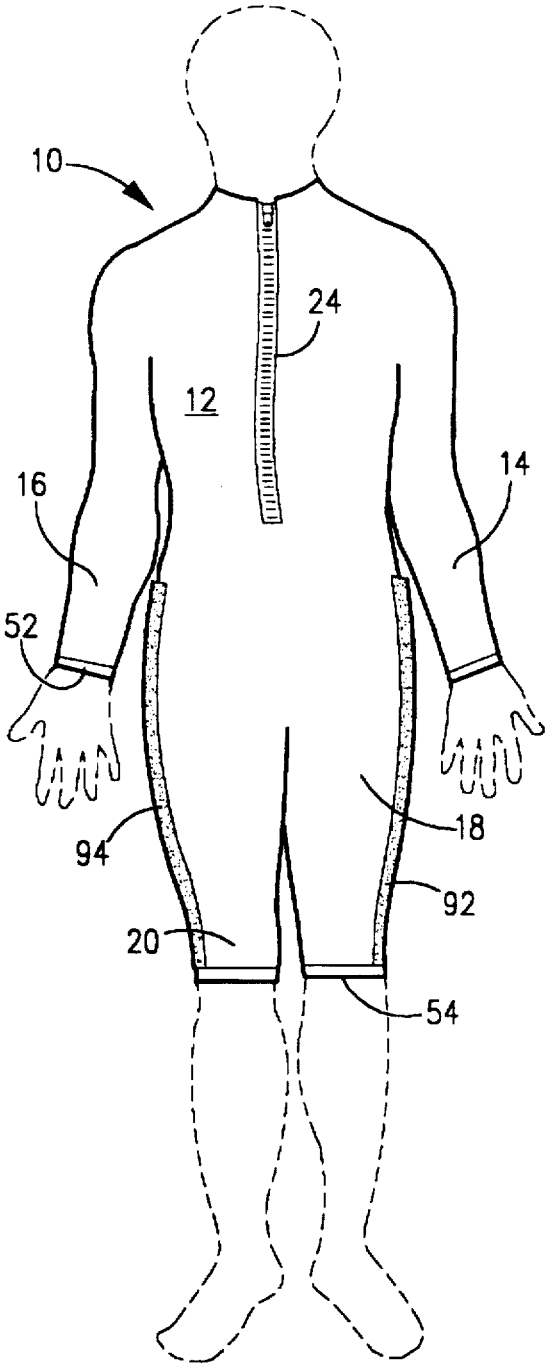
FIG. 3 is a front elevational view of the conditioning system of FIG. 1, with the pockets removed to show the one-piece weight members.
Figure 4:
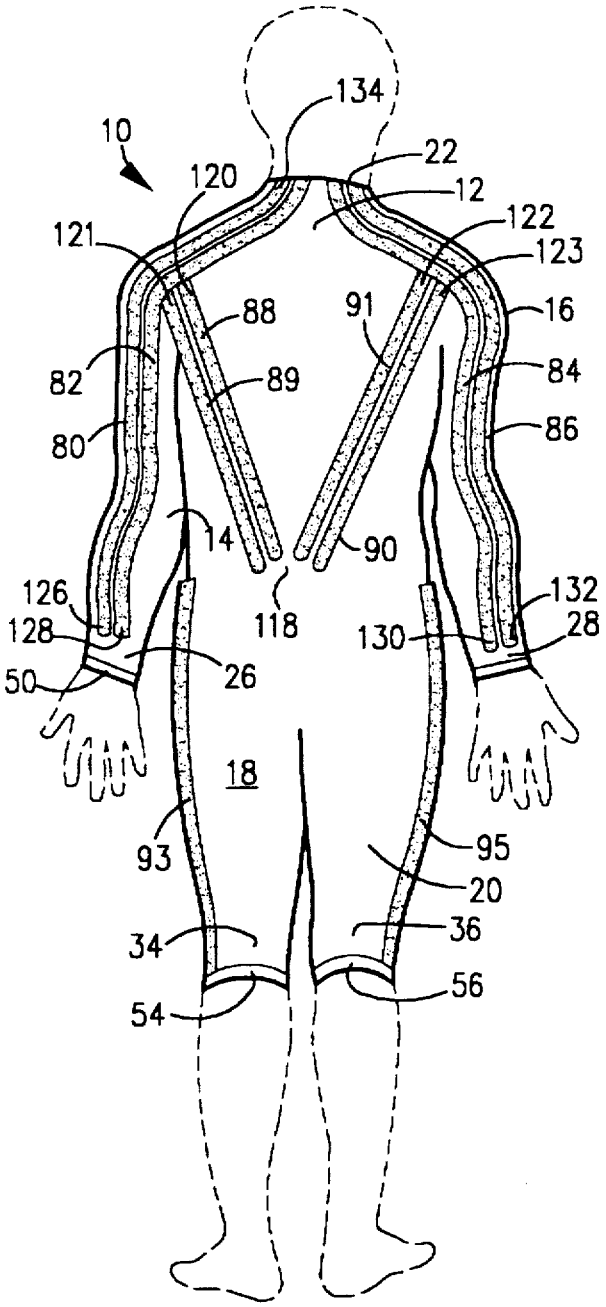
FIG. 4 is a rear elevational view of the conditioning system of FIG. 1, with the pockets removed to show the one-piece weight members.
Figure 5:
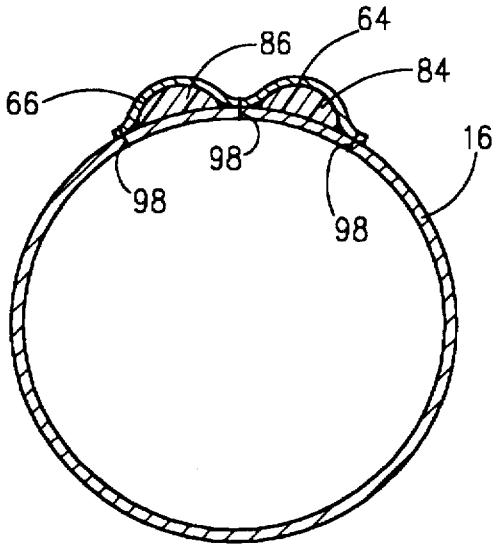
FIG. 5 is a cross sectional view of the conditioning system of FIG. 1, taken along the line 5—5 of FIG. 1.
Figure 6:
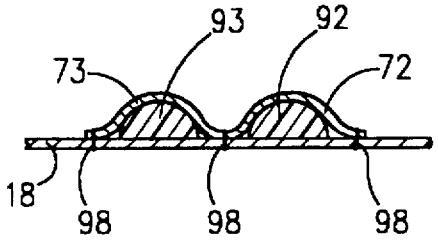
FIG. 6 is a cross sectional view of the conditioning system of FIG. 1, taken along the line 6—6 of FIG. 1.

The suit 10 is provided with elongated pockets 60, 62, 64, 66, 68, 69, 70, 71, 72, 73, 74, 75 (FIG. 2) and respective weight members 80, 82, 84, 86, 88, 89, 90, 91, 92, 93, 94, 95 (FIGS. 3 and 4). The pockets 60–75 are essentially identical to each other in size and construction, except that some are longer than others, as discussed in more detail below. The pockets 60–75 may be formed of the stretchable material described above, and may be sewn to the suit 10 by suitable stitching threads 98 (FIGS. 5 and 6). The pockets 60–75 have respective zippers 100, 102, 104, 106, 108, 109, 110, 111, 112, 113, 114, 115 (FIG. 2) for removing the weight members 80–95 to clean the suit 10, or to replace the weight members 80–95, as discussed in more detail below.

In the illustrated embodiment, the weight members 80–95 are each formed of slender continuous lengths of soft silicone rubber. Silicone rubber is preferred because it provides the desired flexibility and tensile strength and because it is commercially available at a relatively low cost. The weight members 80–95 are essentially identical to each other in size and construction, except that some are longer than others, as discussed in more detail below. The weight members 80–95 extend through essentially the full lengths of the respective pockets 60–75.

The weight members 80–95 are positioned for efficient and safe conditioning. In particular, the arm and shoulder weight members 80, 82, 84, 86 extend from the neck opening 22, over the wearer's shoulders, and along substantially the entire lengths of the respective arm portions 14, 16. These weight members 80–86 are arranged in side by side, essentially parallel pairs. The leg and hip weight members 92, 93, 94, 95 extend from the waist along the entire lengths of the leg portions 18, 20 to the elastic securing means 54, 56. The leg and hip weight members 92–95 (and the respective pockets 112–115) each extend over the respective hip joints.

The weight members 88, 89, 90, 91 located on the back of the torso portion 12 advantageously form a V-shaped structure. The lower ends of the back weight members 88, 89, 90, 91 form an apex 118 at the lumbar spinal region. The upper ends 120, 121, 122, 123 are located adjacent the arm and shoulder weight members 82, 84. An important, advantageous feature of the illustrated system is the even distribution of the weight members 80–95 at desired locations around the user's body.

The weight members 80–95 are held tightly against the wearer's body by the pockets 60–75. The pockets 60–75 are held tightly in place by the tight fitting suit 10. The pockets 60–75 maintain the positions of the weight members 80–95 relative to the wearer's body. For example, the lower ends 118 of the back weight members 88–91 are not permitted to move away from the wearer's back. Similarly, the distal ends 126, 128, 130, 132 of the arm and shoulder weight members 80–86 are not permitted to move with respect to the wearer's wrists.

Moreover, since the weight members 80–95 are formed of a solid material, there is no shifting of weight within the pockets 60–75. This is an important difference between the conditioning suit 10 and prior art weight systems employing particulates (such as sand and lead pellets) and liquids (such as water).

Another important feature of the illustrated embodiment is that the flexible weight members 80–95 each have tensile strength such that the distal portions of the weight members 80–95 are at least partially supported by the respective proximal portions. For example, the distal portion 126 of the first arm and shoulder weight member 80 (in FIG. 4, located next to the left wrist) is integral with the proximal portion 134 (adjacent the neck opening 22).

The upper portion 134 is held tightly against the body by the tight fitting suit 10 and pocket 60. Thus, when the left wrist is rapidly extended away from the body and then abruptly stopped, e.g., during a pitching motion, the tensile strength of the weight member 80 (held tightly within the pocket 60 along essentially its entire length) resiliently restrains the inertial force of the distal portion 126. The tensile strength of the weight member 80 resists movement of the distal portion 126 away from the proximal portion 134. If the weight member 80 had no tensile strength, or if the distal weight portion 126 were not integrally connected to the upper portion 134, the inertial force of the distal portion 126 would be applied to the elbow at the conclusion of the pitching motion.

The suit 10 may be provided in a variety of sizes to comfortably fit the size of the wearer. The zipper 24 should be long enough so that the suit 10 can be easily taken on and off.

The weight members 80–95 and pockets 60–75 may vary in length depending on the lengths of the respective articulates. The lengths of the weight members 80–95 and pockets 60–75 should be approximately the same as the lengths of the corresponding articulates of the wearer. For example, the suit 10 may be provided in tall and short sizes, with the lengths of the weight members 80–95 and pockets 60–75 being correspondingly longer in the tall size than in the short size.

In the illustrated embodiment, for example, the zipper 24 is approximately twenty-four inches long. The arm and shoulder weight members 80–86 and the respective pockets 60–66 may each be about twenty-five and one-half inches long. The back weight members 88–91 and the respective pockets 68–71 may each be about seventeen inches long. The leg and hip weight members 92–95 and the respective pockets 72–75 may each be the same length as the back weight members 88–91, i.e., approximately seventeen inches long.

In the illustrated embodiment, the leg and hip weight members 92–95 and the back weight members 88–91 are essentially identical to each other in terms of length, material and continuous cross section. Likewise, the four arm and shoulder weight members 80–86 are essentially identical to each other in terms of length, material and continuous cross section. This is an important, advantageous feature of the illustrated embodiment. The weight members 80–95 are all removable. Providing the weight members 80–95 with the same material and cross section and in only two lengths makes it easy to properly reassemble the weight members 80–95 into the respective pockets 60–75. Also, all of the weight members 80–95 may be cut from a single source of stock material (not illustrated), which reduces the overall cost of manufacturing the suit 10.

In the illustrated embodiment, the zippers 100–106 for the arm and shoulder pockets 60–66 are each about twenty inches long. The zippers 108–111 for the back pockets 68–71 are each about twelve inches long, and the zippers 112–115 for the leg and hip pockets 72–75 are also each about twelve inches long. Providing the pocket zippers 100–115 in only two lengths helps minimize the total cost of manufacturing the illustrated conditioning suit 10.

The total weight of the illustrated weight members 80–95 may be about one percent of the wearer's body weight. For example, if the suit 10 is designed for a person that weighs about one hundred fifty pounds, then the weight members 80–95 should have a combined weight of about one and one-half pounds. In a preferred embodiment of the invention, additional sets of elastomeric weight members (not illustrated) may be provided. Each additional set of weight members may be essentially identical to the illustrated weight members 80–95, except that the additional weight sets may weigh more than one percent of the wearer's body weight, in suitable increments of for example one percent.

For example, in a preferred embodiment of the invention, the second set of weight members may weigh a total of three pounds (two percent of body weight), the third set of weight members may weigh a total of four and one-half pounds (three percent of body weight), and so on. Someone in relatively poor physical condition (or unknown physical condition) may use the suit 10 initially with the illustrated set of weight members 80–95. When the wearer's condition has improved, the one percent weight members 80–95 may be removed (through the zippers 100–115) and replaced by the second set of weight members (two percent of body weight).

After a period of time, when the condition of the wearer has improved even more, the two percent set of weight members may be replaced by the third set (three percent of body weight), and so on, preferably up to a sixth set of weight members weighing six percent of the wearer's total body weight. The various weight member sets are essentially identical to each other except for weight. The advantages of the invention described above in connection with the illustrated weight members 80–95 are obtained by the suit 10 regardless of which weight set is used. The percentage weight progression described above allows for progressive development in a safe manner and it also allows for a planned progression, again emphasizing safety in progressive development. This program when followed will provide safety in conditioning and in progressive development.

For certain exercise programs, and for certain athletes, it may be desirable to provide a weight increase of greater than six percent. For others, weight increases of greater than six percent may not be safe for the articulates.

Figure 7:
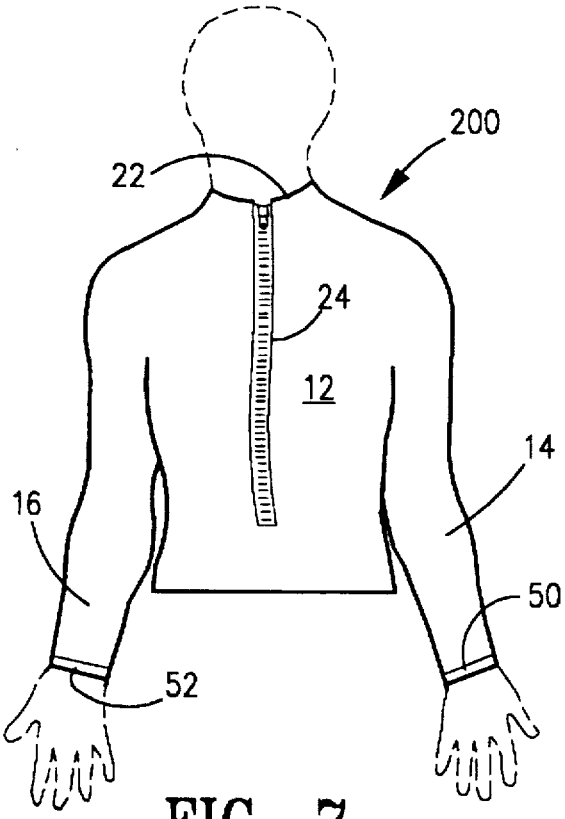
FIG. 7 is a front elevational view of a conditioning system constructed in accordance with another preferred embodiment of the present invention.
Figure 8:
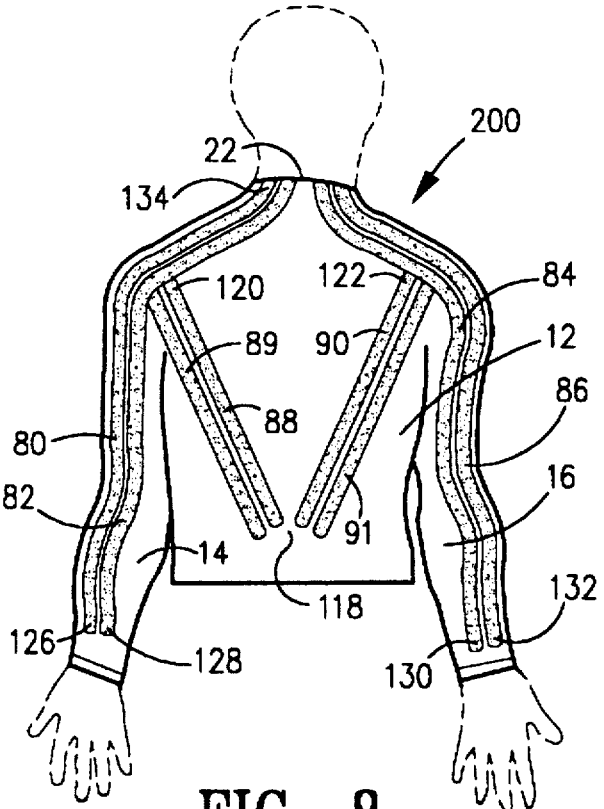
FIG. 8 is a rear elevational view of the conditioning system of FIG. 7, with the pockets removed to show the one-piece weight members.
Figure 11:
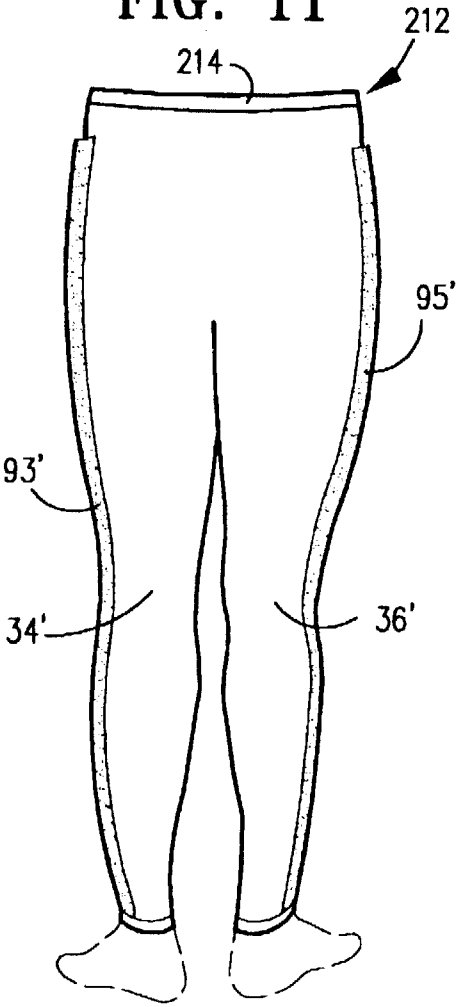
FIG. 11 is a rear elevational view of another conditioning system (full length bottom only) constructed in accordance with the present invention, with the pockets removed to show the one-piece weight members.
Figure 10:
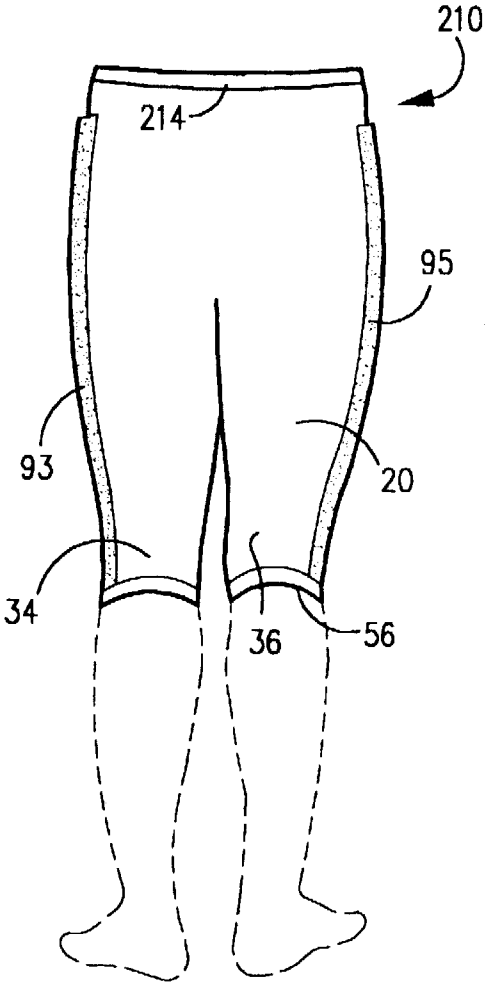
FIG. 10 is a rear elevational view of another conditioning system (three quarter length bottom only) constructed in accordance with the present invention, with the pockets removed to show the one-piece weight members.
Figure 9:
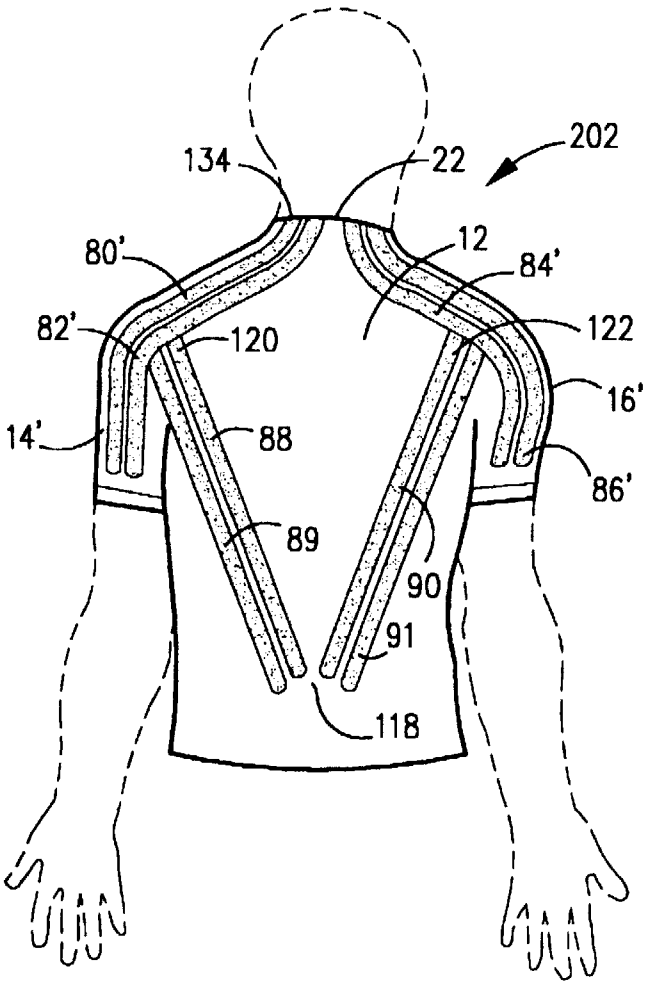
FIG. 9 is a rear elevational view of another conditioning system (top only with short sleeves) constructed in accordance with the present invention, with the pockets removed to show the one-piece weight members.
Figure 12:
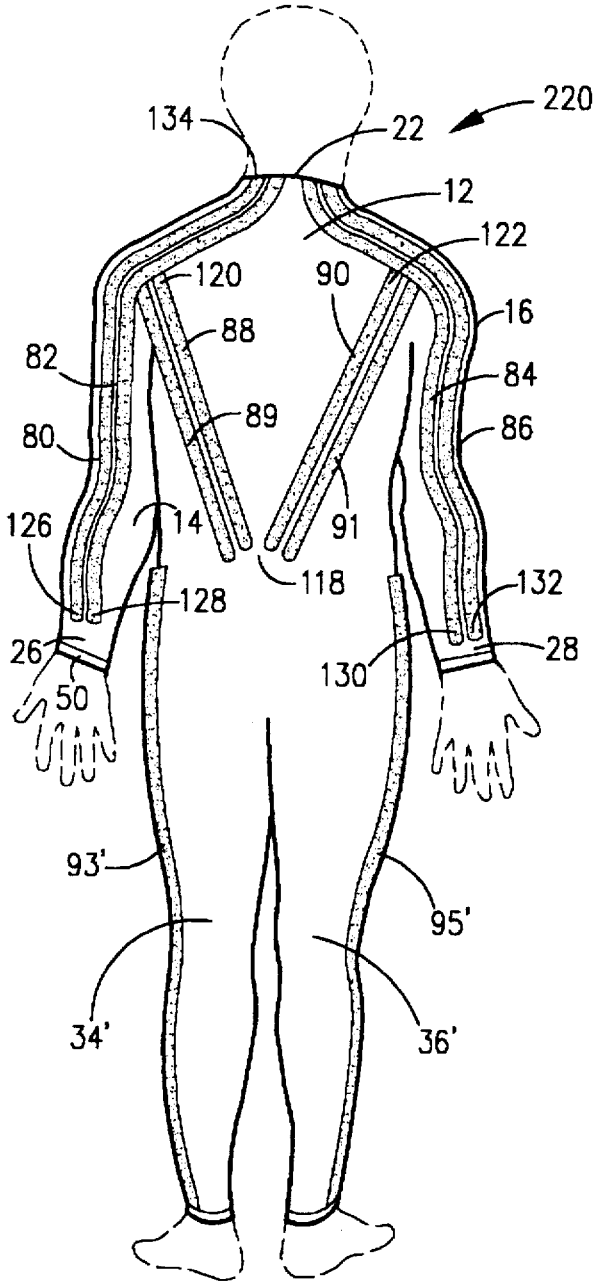
FIG. 12 is a rear elevational view of another conditioning system (full length, one-piece, long sleeves) constructed in accordance with the present invention, with the pockets removed to show the one-piece weight members.
Figure 13:
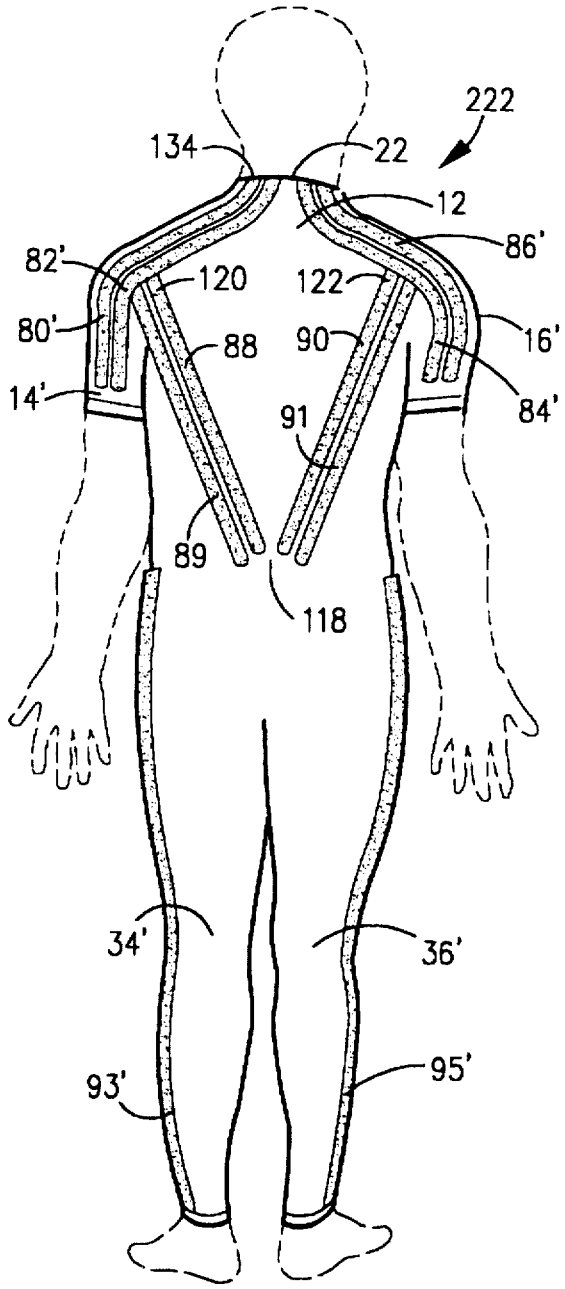
FIG. 13 is a rear elevational view of another conditioning system (full length, one piece, short sleeves) constructed in accordance with the present invention, with the pockets removed to show the one-piece weight members.

The illustrated weight suit 10 may be modified in many ways without departing from the spirit and scope of the present invention. For example, the invention may be practiced by the weight shirts 200, 202 shown in FIGS. 7, 8 and 9. The weight shirts 200–202 have no leg portions. The second weight shirt 202 has short sleeves 14', 16' and reduced length shoulder weight members 80', 82', 84', 86'. The invention may also be practiced by the weight pants 210, 212 shown in FIGS. 10 and 11. The second weight pants 212 have leg portions 34', 36' and weights 93', 95' that are long enough to extend to the wearer's ankles. The weight pants 210, 212 may be supported at the wearer's waist by a suitable waistband 214. The present invention may also be practiced by the full length weight suits 220, 222 shown in FIGS. 12 and 13. Throughout the drawings, like reference numerals designate like elements.

The above description illustrates preferred embodiments which achieve the objects, features and advantages of the present invention. The invention is defined by the following claims. The invention is not limited to the preferred embodiments. All modifications coming within the spirit and scope of the following claims are to be considered part of the present invention.

What is claimed as new and desired to be protected by Letters Patent of the United States is:

1. A method of conditioning a human body, said body having a joint, said method comprising the steps of:

performing an activity while wearing a suit over said body joint and while said suit is provided with a first set of weight members, a first one of said weight members having a distal end portion and a proximal end portion, said first weight member being located over said body joint such that said body joint is located between said end portions;

subsequently, removing said first set of weight members from said suit; and subsequently, performing said activity while wearing said suit with a second set of weight members, said second set of weight members being heavier than said first set of weight members.

2. The conditioning method of claim 1, further comprising the steps of wearing said suit with a third set of weight members, said third set of weight members being heavier than said second set of weight members, subsequently removing said third set of weight members from said suit, wearing said suit with a fourth set of weight members, said fourth set of weight members being heavier than said third set of weight members, subsequently removing said fourth set of weight members from said suit, wearing said suit with a fifth set of weight members, said fifth set of weight members being heavier than said fourth set of weight members, subsequently removing said fifth set of weight members from said suit, and wearing said suit with a sixth set of weight members, said sixth set of weight members being heavier than said fifth set of weight members.

3. The conditioning method of claim 2, wherein said suit is worn on a human body, and wherein said first, second, third, fourth, fifth and sixth sets of weight members weigh approximately one, two, three, four, five and six percent of the total weight of the body of the wearer, respectively.

4. The conditioning method of claim 1, further comprising the step of using stretchable material to hold said first one of said first set of weight members tightly against said body joint during said activity.

5. The conditioning method of claim 4, further comprising the step of locating said second set of weight members within elongated pockets, and stretching said pockets to receive said second set of weight members.

6. The conditioning method of claim 5, further comprising the step of causing said first one of said first set of weight members to bend by bending said body joint during said activity.

7. The conditioning method of claim 6, further comprising the step of locating said first one of said first set of weight members such that the movement of said first one of said first set of weight members mimics the movement of said body joint.

8. The conditioning method of claim 4, further comprising the step of locating said suit around the torso and shoulders of said human body such that a first one of said shoulders is located between said end portions of said first one of said first set of weight members, and wherein said activity includes exercising said shoulders.

9. The conditioning method of claim 8, further comprising the steps of locating said second set of weight members in elongated pockets and stretching said pockets to receive said second set of weight members.

10. The conditioning method of claim 9, further comprising the step of preventing said distal end portion from moving away from said proximal end portion during said activity.

11. The conditioning method of claim 5, further comprising the step of locating said suit over the elbows of said human body such that a first one of said elbows is located between said end portions, and wherein said activity includes bending said elbows.

12. The conditioning method of claim 11, further comprising the step of causing said first one of said first set of weight members to bend by bending one of said elbows.

13. A conditioning method comprising the steps of:

performing an activity while wearing a suit with a first set of weight members;

subsequently, removing said first set of weight members from said suit; and subsequently, performing said activity while wearing said suit with a second set of weight members, said second set of weight members being heavier than said first set of weight members; and wherein said method further comprises the steps of wearing said suit with a third set of weight members, said third set of weight members being heavier than said second set of weight members, subsequently removing said third set of weight members from said suit, wearing said suit with a fourth set of weight members, said fourth set of weight members being heavier than said third set of weight members, subsequently removing said fourth set of weight members from said suit, wearing said suit with a fifth set of weight members, said fifth set of weight members being heavier than said fourth set of weight members, subsequently removing said fifth set of weight members from said suit, and wearing said suit with a sixth set of weight members, said sixth set of weight members being heavier than said fifth set of weight members; and wherein said suit is worn on a human body, and wherein said first, second, third, fourth, fifth and sixth sets of weight members weigh approximately one, two, three, four, five and six percent of the total weight of the body of the wearer, respectively.

* * * * *